US006100488A

United States Patent [19]

Satake et al.

[11] Patent Number: 6,100,488

[45] Date of Patent: Aug. 8, 2000

[54] GRANULAR MATERIAL COLOR SORTING APPARATUS UTILIZING FLUID JETS WITH AN INJECTION DELAY CONTROL UNIT

[75] Inventors: Satoru Satake, Tokyo; Takafumi Ito, Mihara; Nobuyoshi Ikeda, Hiroshima-ken, all of Japan

[73] Assignee: Satake Corporation, Tokyo, Japan

[21] Appl. No.: 09/135,262

[22] Filed: Aug. 17, 1998

[30] Foreign Application Priority Data

Aug. 19, 1997 [JP] Japan ..... 9-239001
Oct. 13, 1997 [JP] Japan ..... 9-296323

[51] Int. Cl.[7] ..... B07C 5/342; B07C 5/00

[52] U.S. Cl. ..... 209/580; 209/581; 209/587; 209/638; 209/639; 209/644; 209/932; 209/938

[58] Field of Search ..... 209/639, 638, 209/580, 581, 644, 932, 938, 587

[56] References Cited

U.S. PATENT DOCUMENTS 5,353,937 10/1994 Childress ..... 209/587
5,407,082 4/1995 Childress et al. ..... 209/587
5,413,222 5/1995 Holder ..... 209/639
5,638,961 6/1997 Satake et al. ..... 209/639
5,779,058 7/1998 Satake et al. ..... 209/639
5,862,919 1/1999 Eason ..... 209/587
5,894,938 4/1999 Ichese et al. ..... 209/579

FOREIGN PATENT DOCUMENTS 425088 6/1972 Australia .
0719 598 A2 7/1996 European Pat. Off. ..... B07C 5/342
6-41876 6/1994 Japan .

*Primary Examiner*—Donald P. Walsh
*Assistant Examiner*—Brett C. Martin
*Attorney, Agent, or Firm*—Darby & Darby

[57] ABSTRACT

A granular material sorting apparatus comprises a transfer device for causing material grains to fall down, optical detector units mounted along the falling-down locus of the material grains, an injection nozzle device for injecting air to the material grains, and a control unit for controlling operation of the injection nozzle device in response to detection by the optical detector unit. The optical detector units and the control unit optically detect and discriminate colored grains different in color from good material grains and foreign matters in similar color to the good material grains or transparent, which are mixed in the material grains, and activate the injection nozzle device in a predetermined period of time after the detection to remove the detected bad grains. The control unit sets different injection times and different injection delay times depending whether the bad grains are colored grains or foreign matters.

6 Claims, 7 Drawing Sheets

GRANULAR MATERIAL COLOR SORTING APPARATUS UTILIZING FLUID JETS WITH AN INJECTION DELAY CONTROL UNIT

The present U.S. Pat. application claims priority from Japanese application No. 09-239001 filed Aug. 19, 1997 and Japanese application No. 09/296323 filed Oct. 13, 1997.

BACKGROUND OF THE INVENTION

The present invention relates to a granular material color sorting apparatus which optically detects and removes bad grains in cereal grains such as rice grains, wheat grains or the like. The "bad grain" used herein means colored grains such as degenerated cereal grains, and foreign matters such as pieces of glass or stones in similar color to good cereal grains or transparent.

The granular material color sorting apparatus to be improved by the invention comprises a feed device for material grains, a transfer device adapted to make the material fed from the feed device flow down, an optical detector unit mounted near the terminal end of the transfer device, an injection nozzle device mounted along the path of falling-down of the material from the transfer device, and a control unit connected to the optical detector unit and the injection nozzle device. In this sorting apparatus, the material grains fall down from an inclined sliding surface of the transfer device through a substantially constant locus, and the optical detector unit optically detects the material grains. The control unit discriminates good and bad grains based on the optical detection value, and activates the injection nozzle device to blow off the bad grains. Thus, the bad grains are sorted from the material grains.

When it is intended to sort colored grains and foreign matters in the material, the optical detector unit uses a visible light sensor for detecting the colored grains, and a near infrared sensor for detecting glass or stones. Such granular material color sorting apparatus is found, for example, in U.S. Pat. No. 5,638,961 of the same assignee as the present invention.

In this case, the control unit has a comparator, an injection time control section, and an injection delay control section. The comparator compares a detected value of the optical detector unit with a predetermined threshold to discriminate bad grains from good grains. The injection time control section activates the injection nozzle device for a predetermined period of time to inject air. The injection delay control section delays the operation of the injection nozzle device for a predetermined period of time after detection of a bad grain. In operation, as shown in FIG. 9, if detection signals S1 and S3 from the near infrared sensor 130 and a detection signal S2 from the visible light sensor 120 exceed thresholds, the comparator 140 determines them as bad grains, and outputs signals N1, N2 and N3 indicating the bad grains. The injection delay control section 180 and the injection time control section 190 output signals T1, T2 and T3 of a fixed delay time t, as well as signals F1, F2 and F3 of a fixed injection time f in response to the bad grain signals N1, N2 and N3, respectively, to activate the injection nozzle device.

By the way, a foreign matter such as glass or a stone, as compared with a good cereal grain or a colored cereal grain, is higher in specific gravity and lower in frictional resistance when flowing down on the sliding surface of the transfer device, so that it falls down from the transfer device at a higher speed. Therefore, when the comparator determines a bad grain, the injection delay control section 180 activates the injection nozzle device at a relatively short period of delay time or timing for enabling capture of glass or a stone of a higher falling-down speed. On the other hand, the injection time control section 190 outputs an injection time f for enabling capture of even a colored cereal grain of a lower falling-down speed so as to remove the bad grain. As described, one activation of the injection nozzle device is necessary to have a long injection time f so that bad grains being determined can be removed regardless of colored cereal grains or foreign matters such as glass or stones, and thus consumes much air. In addition, there is a problem that, since the injection time f is long, good cereal grains before and after a bad grain are also removed by an injected air flow in a higher ratio, and it becomes impossible to sort only bad grains.

In this connection, Japanese Utility Model Application Laid-Open Publication No. 6-41876 proposes a sorting apparatus varying a driving time and a driving delay time for air injection depending on the lengths of objects to be sorted. This apparatus is for small objects such as pharmaceuticals or electronic components, has an optical detector unit for sensing the length of an object to be sorted, and is provided in an air nozzle driving system with means for changing the activation time of an air nozzle in response to its detection signal.

The sorting apparatus described in this publication is so constructed as to control the injection or drive time and/or the delay time of the air nozzle driving system depending on a detection signal of length of an object to be sorted. Therefore, the apparatus may effectively sort bad ones different from good articles only in size, but may not sufficiently sort colored grains or foreign matters such as glass or stones of different falling-down speeds.

SUMMARY OF THE INVENTION

In view of the above problems, the present invention has an object of providing a granular material sorting apparatus which can accurately and economically remove bad grains mixed in a material and having different falling-down speeds from each other.

Another object of the present invention is to provide a granular material color sorting apparatus which consumes less air to be injected in sorting colored grains or foreign matters such as glass or stones out from material cereal grains, and by which only bad grains can be sorted accurately and surely.

To these objects, the invention aims at controlling an injection nozzle device so that it differently operates in removing colored grains and in removing foreign matters.

A granular material color sorting apparatus according to one aspect of the invention comprises a transfer device for causing material grains to fall down in a substantially fixed locus, at least one optical detector unit mounted along the falling-down locus of the material grains, an injection nozzle device for injecting air to the material grains after the optical detection to remove them, and a control unit for controlling operation of the injection nozzle device in response to the detection by the optical detector unit. The optical detector unit comprises a colored grain detection sensor section for optically detecting colored grains different in color from good material grains, and a foreign matter detection sensor section for optically detecting foreign matter in similar color to the good material grains or transparent. The control unit has a comparator section for discriminating the good material grains and bad grains of colored grains and foreign matters based on output signals from the optical detector unit, an injection time control section for activating the injection nozzle device over a predetermined period of time depending on discrimination by the comparator section, and an injection delay control section for delaying the activation of the injection nozzle device for a predetermined period of time after the detection by the optical detector unit. The injection time control section and the injection delay control section are adapted to output different injection times and different injection delay times to the injection nozzle device depending on colored grains or foreign matters.

With this arrangement, in sorting colored grains and foreign matters such as glass or stones mixed in the material, which are different in falling-down speed from each other, it is possible to operate the injection nozzle device with a necessary injection time and an optimal delay time according to a colored grain or a foreign matter. Thus, there is no need to set one injection at a long period of time for enabling removal of both a colored grain and a foreign matter as is in the conventional art, so that air consumption of the apparatus can be reduced. In addition, it becomes possible to accurately sort only a bad grain without blowing off good grains before and after the bad grain.

The injection time control section and the injection delay control section are preferably adapted to set the injection time and the injection delay time for the injection nozzle device according to the magnitude of a colored grain detection signal from the colored grain detection sensor section and to that of a foreign matter detection signal from the foreign matter detection sensor section. Thus, removal of bad grains can be more effectively performed by setting the operation of the injection device in more detail depending on the magnitude of a detection signal, that is, the size of a bad grain.

For each of the color grain detection sensor section and the foreign matter detection sensor section, it is preferable to provide a set of the injection time control section and the injection delay control section. Thus, when the colored grain detection sensor section and the foreign matter detection sensor section are arranged to perform the detection of light from the same position, even if an optical detection position is shifted due to displacement of the setting position, bad grains can be properly eliminated by changing and adjusting the injection time and the injection delay time corresponding to each sensor section. In addition, there is no need of a cumbersome adjusting operation for correcting displacement of the optical detection position by changing an angle of the optical detector unit or the like.

The granular material color sorting apparatus according to another aspect of the invention is provided with set of the injection time control section and the injection delay control section for each of the colored grain detection sensor section and the foreign matter detection sensor section.

With this arrangement, in sorting colored grains and foreign matters such as glass or stones mixed in the material, which are different in falling-down speed from each other, it is possible to separately set the injection time and the injection delay time for the colored grains, and those for the foreign matters such as glass or stones. Thus, there is no need to set one injection at a long period of time for enabling removal of both a colored grain and a foreign matter as is in the conventional art, so that air consumption of the apparatus can be reduced. In addition, it becomes possible to accurately sort only a bad grain without blowing off good grains before and after the bad grain.

Further, the injection time control section and the injection delay control section may be provided with an input section for inputting and setting an injection time and an injection delay time. By the provision of such input section, an operator can appropriately set an injection time and an injection delay time in the injection time control section and the injection delay control section according to the situation of sorting.

BRIEF DESCRIPTION OF THE DRAWINGS

The above and other objects, features and advantage will be more apparent from the description that will be made on embodiments with reference to the attached drawings, in which.

DESCRIPTION OF THE PREFERRED EMBODIMENTS

The embodiments of the invention will be described with reference to FIGS. 1 through 8.

Figure 1:
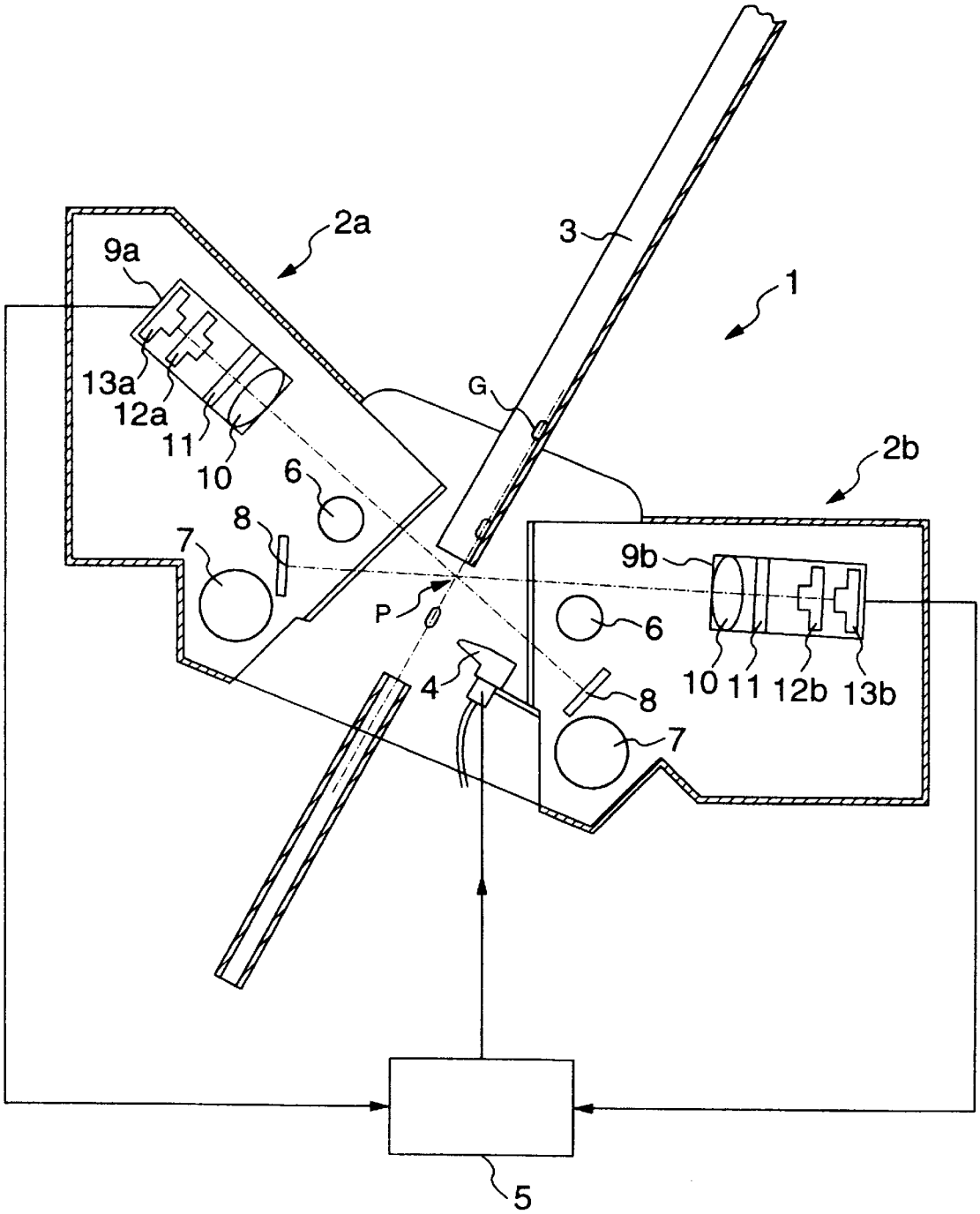
FIG. 1 is a schematic view showing the granular material color sorting apparatus according to an embodiment of the invention.

Referring to FIG. 1, the granular material color sorting apparatus 1 according to the first embodiment of the invention comprises a transfer device 3 for transferring material grains G, optical detector units 2*a* and 2*b* for optically detecting the material G, an injection nozzle device 4 for removing bad grains with air injection, and a control unit 5 for controlling operation of the injection nozzle device 4 based on output signals of the optical detector units 2*a* and 2*b*.

The transfer device 3 has an inclined transfer path, receives the material grains G from feed means (not shown), and causes them to fall down in a substantially fixed locus. The optical detector units 2*a* and 2*b* are disposed on opposite sides of the locus of the material grains G falling down from the terminal end of the transfer path of the transfer device 3 with the locus interposed between them. The injection nozzle device 4 is disposed below one of the optical detector units so that it injects air to the material G after the optical detection.

Each of the optical detector units 2*a* and 2*b* includes a halogen lamp 6, a fluorescent lamp 7, a back-ground 8, and an optical detection section 9*a* or 9*b*. Each optical detection section 9*a* or 9*b* has a condenser lens 10, an optical filter 11, a colored grain detection sensor or a visible light sensor 12*a* or 12*b* for detecting colored grains, and a foreign matter detection sensor or a near infrared sensor 13*a* or 13*b*, for detecting foreign matters such as glass or stones. These optical detection sections 9*a* and 9*b* are mounted to receive light from the same optical detection position P in the falling-down locus of the material grains G.

Here, the structure and operation of the granular material color sorting apparatus 1 may be similar to, for example, those described in U.S. Pat. No. 5,638,961 referred to above, except for the optical detection/control system, and will not be described any further.

Figure 2:
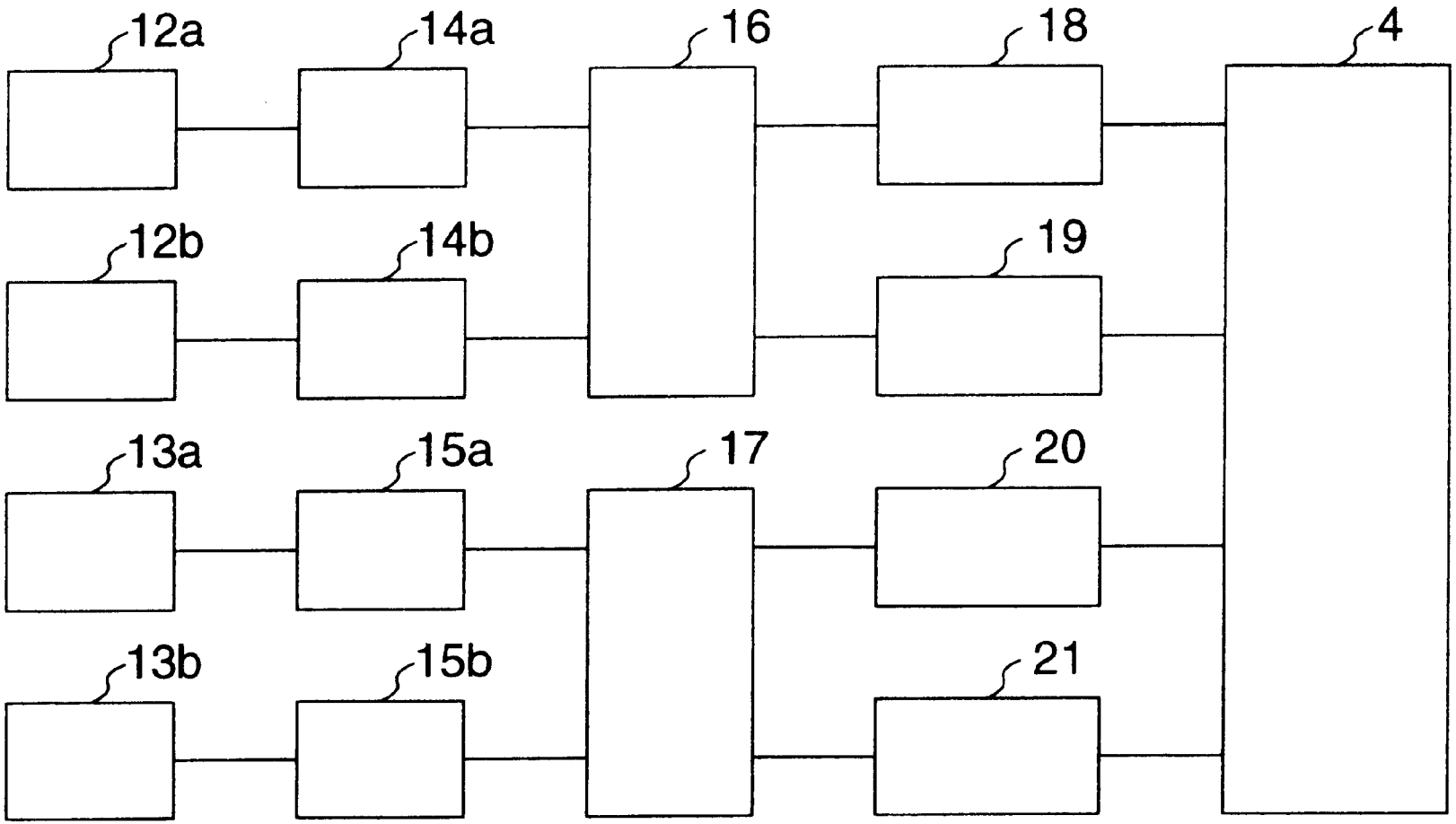
FIG. 2 is a block diagram showing a detection/control system in the apparatus of FIG. 1.

Subsequently, there is described the detection/control system including the optical detection units 2*a* and 2*b*, and a control unit 5 with reference to FIG. 2.

Each of the visible light sensors 12*a* and 12*b* of the optical detection unit connects to an amplifier 14*a* or 14*b* through an I/V converter (not shown), and then to a comparator or a detection signal determination section 16. The I/V converter converts a value of detected quantity of light by the visible light sensor into a voltage value, and the amplifier amplifies the voltage value. The detection signal determination section 16 is an electronic circuit device storing thresholds indicating good cereal grains, determines good and bad grains by comparing the amplified voltage value or detection signal with the thresholds, and determines magnitude of the detection signal of a bad grain, or the length L described later. In addition, the detection signal determination section 16 is connected with an injection delay control section 18 and an injection time control section 19, which are connected to the injection nozzle device 4, respectively. The injection delay control section 18 is an electronic circuit device for delaying air injection from the injection nozzle device 4 for a predetermined period of time, while the injection time control section 19 is an electronic circuit device for activating the injection nozzle device 4 over a predetermined period of time.

Each of the near infrared sensors 13*a* and 13*b* also connects to an amplifier 15*a* or 15*b* through the I/V converter (not shown) as in the visible light sensor described above, and then to a detection signal determination section 17. The I/V converter converts a value of detected quantity of light by the near infrared sensor into a voltage value, and the amplifier amplifies the voltage value. The detection signal determination section 17 is an electronic circuit device storing thresholds indicating good cereal grains, compares the amplified voltage value or detection signal with the thresholds to determine good and bad grains, and determines magnitude of the detection signal of a bad grain. In addition, the detection signal determination section 17 is connected with an injection delay control section 20 and an injection time control section 21, which are connected to the injection nozzle device 4, respectively. The determination section 17, and the control sections 20 and 21 are electronic circuit devices.

A silicon photo-sensor, CCD line sensor or the like is used for the visible light sensor or colored grain detection sensor 12*a*, 12*b*, and a germanium photo-sensor, InGaAs array sensor or the like is used for the near infrared sensor or foreign matter sensor 13*a*, 13*b*.

Now, the second embodiment of the invention will be described. This granular material color sorting apparatus, similarly to the above embodiment, may be of the structure that is the same as the conventional apparatus, except for the optical detection/control system, and here only the optical detection/control system will be described based on FIG. 5. In addition, those components of the second embodiment which may be similar to the above embodiment will be designated by like reference signs, and their description will be omitted.

Each of the visible light sensors 12*a* or 12*b* of the optical detection unit connects to an amplifier 14*a* or 14*b* through an I/V converter (not shown), to which amplifier a comparator 22*a* or 22*b* is connected. Similar to the above embodiment, the I/V converter converts a value of detected quantity of light by the visible light sensor into a voltage value, and the amplifier amplifies the voltage value. Each comparator stores thresholds indicating good grains, and compares the amplified voltage value or detected signal with the thresholds to determine good grains and bad grains. In addition, the comparators 22*a* and 22*b* are connected with an injection time control section 24 and an injection delay control section 25, and the injection delay control section 25 connects to the injection nozzle device 4. The injection time control section 24 causes the injection nozzle device 4 to inject air over a predetermined period of time, and the injection delay control section 25 delays operation of the injection nozzle device 4 for a predetermined period of time.

Each of the near infrared sensors 13*a* and 13*b* of the optical detector unit connects to an amplifier 15*a* or 15*b* through an I/V converter (not shown), and then to a comparator 23*a* or 23*b*. The I/V converter converts a value of detected quantity of light by the near infrared sensor into a voltage value, and the amplifier amplifies the voltage value. Each comparator compares the amplified voltage value or detection signal with the thresholds to determine good grains and bad grains. In addition, the comparators 23*a* and 23*b* are connected with an injection time control section 26 and an injection delay control section 27, and the injection delay control section 27 connects to the injection nozzle device 4. The injection time control section 26 causes the injection nozzle device 4 to inject air over a predetermined period of time, and the injection delay control section 27 delays operation of the injection nozzle device 4 for a predetermined period of time.

The control unit of this embodiment may be provided with an input section that is capable of setting and inputting an activation time and a delay time for air injection. Such input section 28 is indicated as connected to the injection time control sections 24 and 26, and the injection delay control section 25 and 27 by broken lines in FIG. 5.

Now, the third embodiment of the present invention will be described. This granular material color sorting apparatus will be also described only for an optical detection/control system based on FIG. 6, and components which may be similar to the above embodiments will be designated by like reference signs.

The optical detection/control system of this embodiment has an essential arrangement that is similar to the second embodiment, and differs only in the number of injection time control section and injection delay control section. That is, the second embodiment has a set of injection time control section and injection delay control section for each pair of visible light sensor and near infrared sensor. On the other hand, the third embodiment is provided with a set of injection time control section 24*a*, 24*b*, 26*a* or 26*b* and injection delay control section 25*a*, 25*b*, 27*a* or 27*b* for each of visible light sensor and near infrared sensor.

Subsequently, the first through third embodiments will be described for the operation of their optical detection/control systems.

First, in the apparatus of the first embodiment, when the material grain G falls down from the transfer device 3, and reaches the optical detection position P, the visible sensors 12*a* and 12*b* detect the quantity of light from the material G. The values of detected quantities of light are converted into voltage values by the I/V converter. The voltage values are amplified by the amplifiers 14*a* and 14*b*, and output to the detection signal determination section 16 as detection signals.

Figure 3:
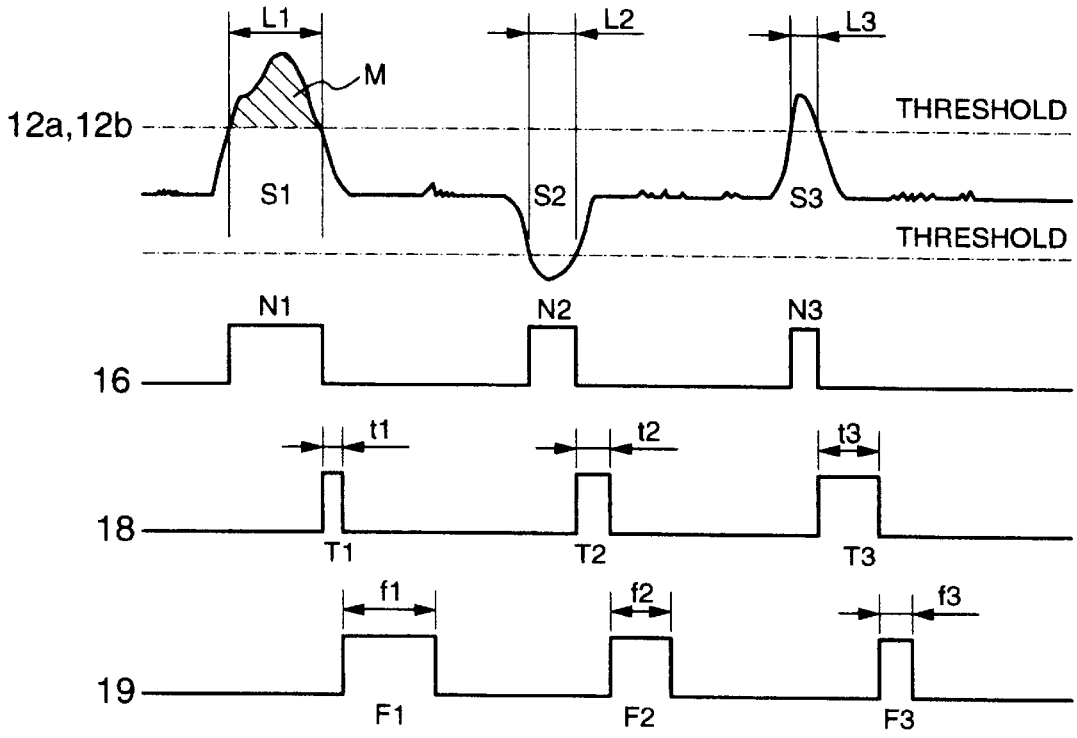
FIG. 3 is charts showing the output waveform of detection and control signals by a visible light sensor in the system of FIG. 2.

FIG. 3 shows the detection signals or voltage values S1, S2 and S3 corresponding to the quantities of detected light by the visible light sensors 12*a* and 12*b*. The detection signal determination section 16 compares the detection signals S1, S2 and S3 with the thresholds, if they exceed the thresholds, determines that they are bad grains or colored grains, and outputs bad grain signals N1, N2 and N3. In this case, the detection signal determination section 16 determines widths L1, L2 and L3 of the detection signals S1, S2 and S3, and outputs values of the respective widths L1, L2 and L3 as the magnitude of detection signals of bad grains to the injection delay control section 18 and the injection time control section 19. The injection delay control section 18 and the injection time control section 19 store and are set with the injection times and the injection delay times corresponding to the values of width of detection signals, respectively. The injection delay control section 18 and the injection time control section 19 automatically select the injection times and the injection delay times according to the values of width of the detection signals from the detection signal determination section 16, and output delay signals T1, T2 and T3 and activation signals F1, F2 and F3 to a drive circuit (not shown) for activating the injection nozzle device 4. Then, the injection nozzle device 4 receives these signals, and operates at the predetermined injection delay times and injection times.

As shown in FIG. 3, the injection delay control section 18 selects injection delay times t1, t2 and t3 depending on the values of width of the detection signals S1, S2 and S3 determined as bad grains. The injection delay time t is inversely proportional to the value of width of a detection signal, and set to t3>t2>t1 if the widths of the detection signal have values of L1>L2>L3. That is, when the width of a detection signal is large, it is assumed that the grain is large. Since a larger grain has a higher falling-down speed, and reaches the injection nozzle device faster, the delay time is made shorter from the detection to the activation of the nozzle. On the other hand, the injection time control section 19 also selects, as shown in FIG. 3, injection times f1, f2 and f3 depending on the values of width of the detection signals S1, S2 and S3 determined as bad grains. However, the injection time f is proportional to the value of width of a detection signal, and set to f1>f2>f3 if the widths of the detection signal shown in FIG. 3 have values of L1>L2 >L3. That is, when the width of a detection signal is large, as described above, it is assumed that the grain is large. Since a larger grain is heavier, the injection time is made longer to remove the heavier grain.

Figure 4:
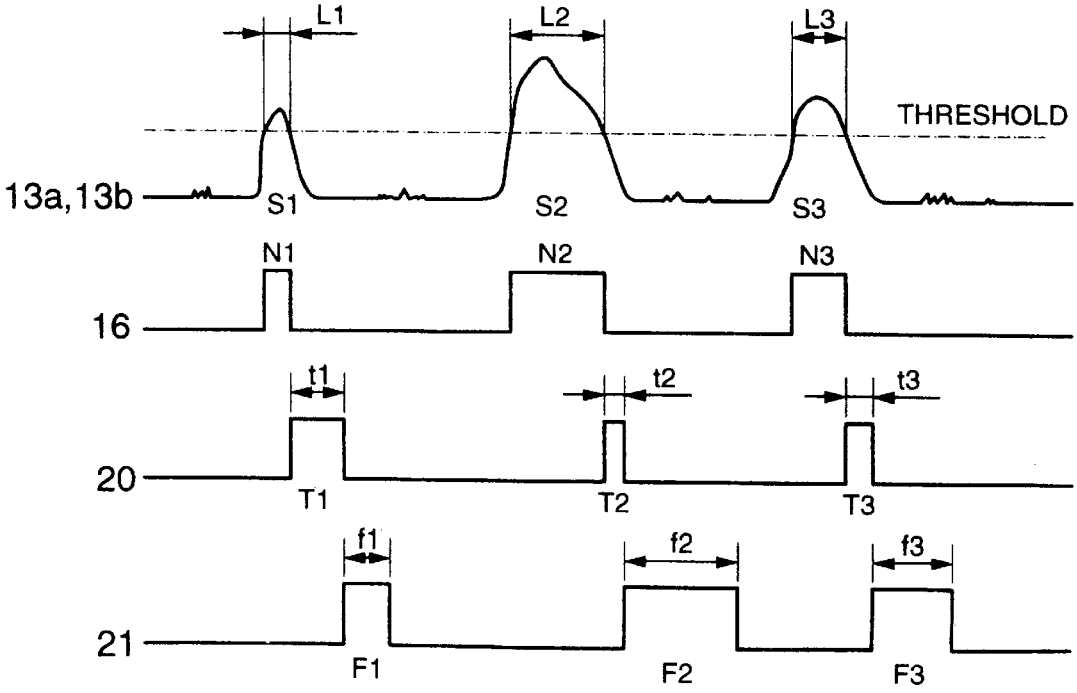
FIG. 4 is charts showing the output waveform of detection and control signals by a near infrared sensor in the system of FIG. 2.
Figure 5:
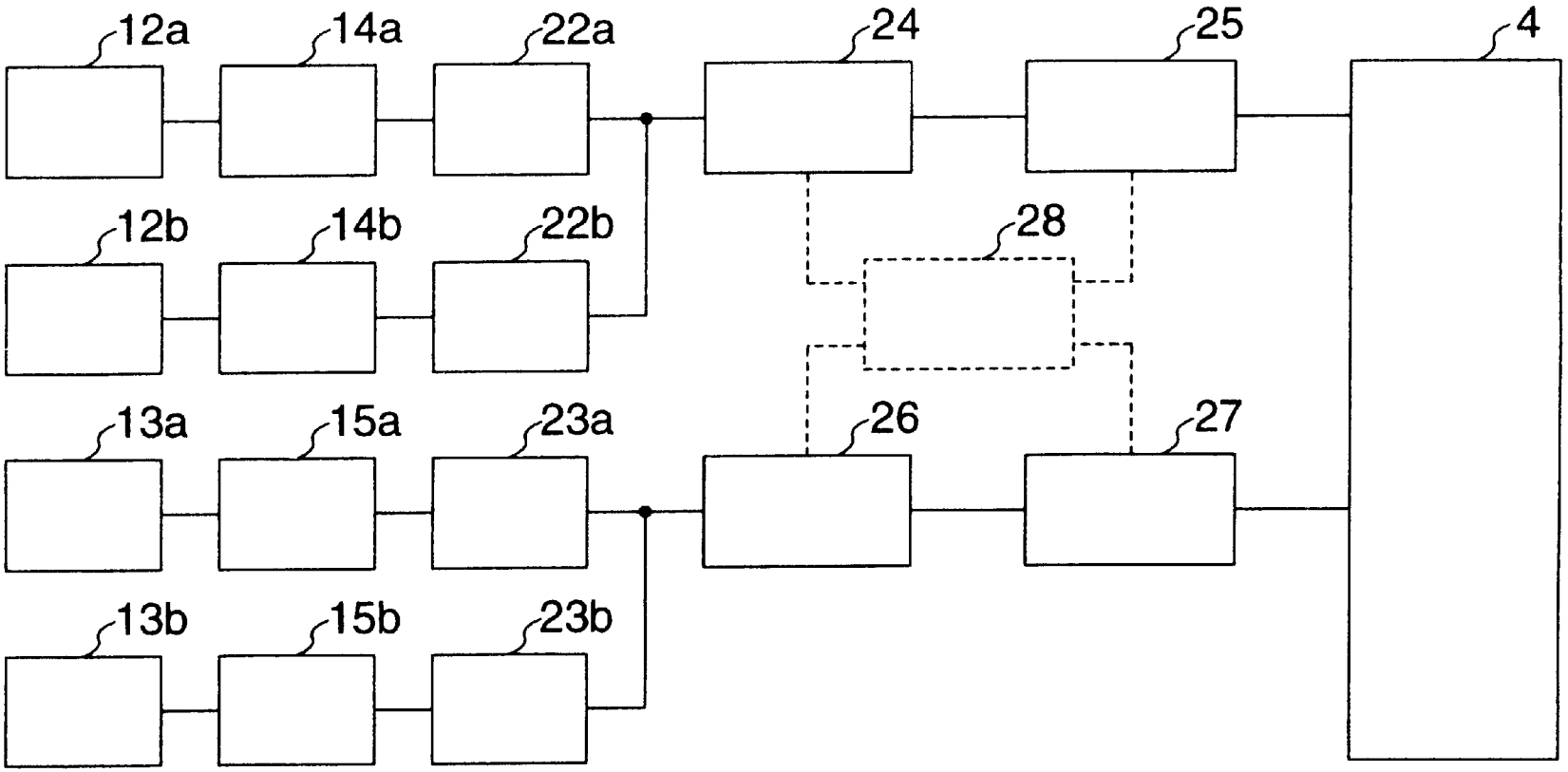
FIG. 5 is a block diagram showing a detection/control system of the granular material color sorting apparatus according to the second embodiment of the invention.
Figure 6:
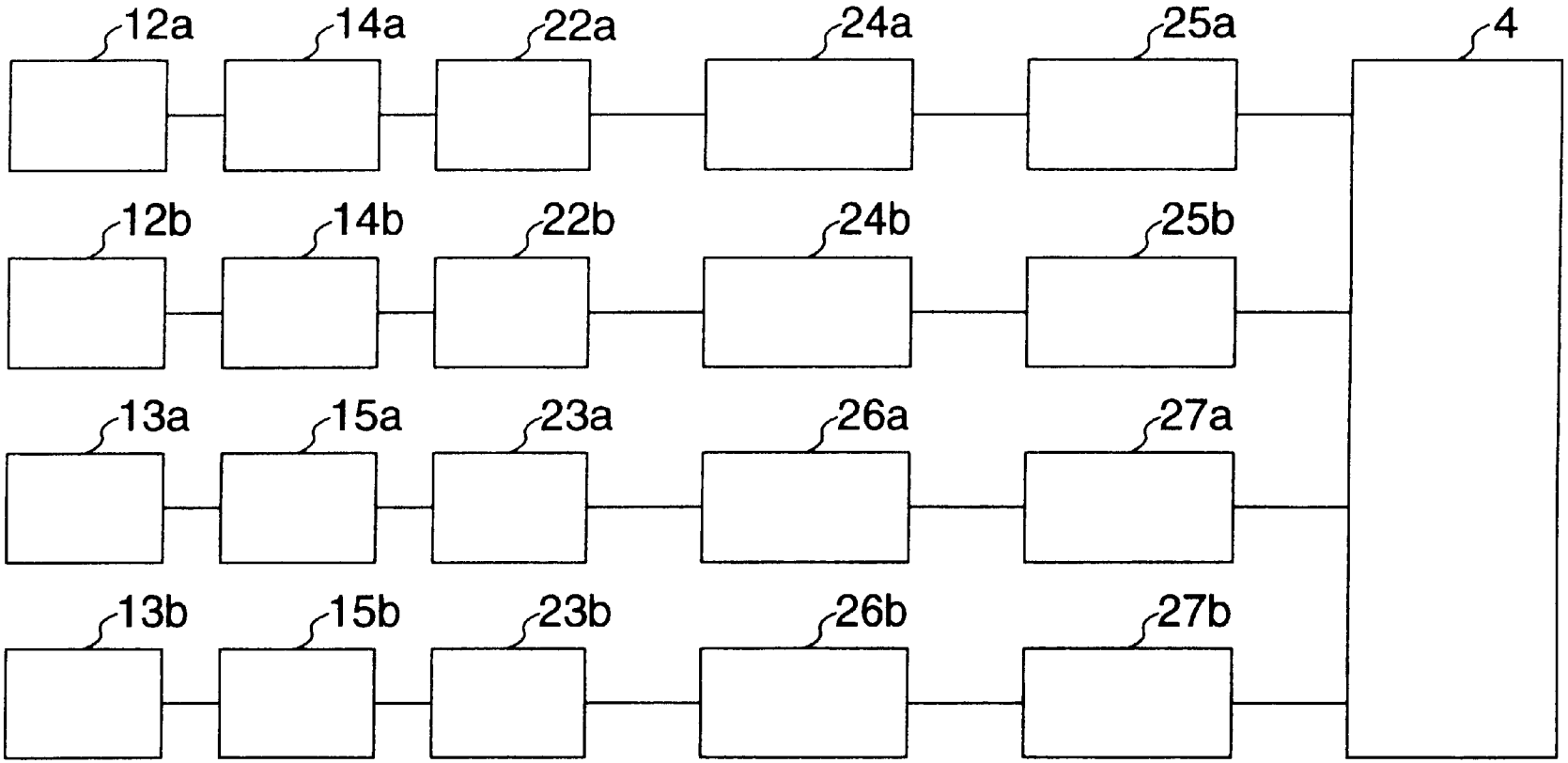
FIG. 6 is a block diagram showing a detection/control system of the granular material color sorting apparatus according to the third embodiment of the invention.

As for the near infrared sensors 13*a* and 13*b* for detecting foreign matter such as glass or stones, similarly to the visible light sensors 12*a* and 12*b* described above, the injection delay times t and the injection times f are previously stored and set in the injection delay control section 20 and the injection time control section 21, respectively. These times have setting depending on the values of width L1, L2 and L3 of the detection signals S1, S2 and S3 determined as bad grains, and taking into account the fact that foreign matters have higher falling-down speeds than colored grains. That is, for a foreign matter such as glass or stone, even if it has the same value of width of a detection signal, the injection time and the injection delay time are set to be longer and shorter than those for a colored grain such as a discolored cereal grain. As shown in FIG. 4, in the injection delay control section 20, the injection delay time t is inversely proportional to the values of width L2>L3>L1 of the detection signals, and predetermined times t1>t3>t2 are automatically selected. In addition, in the injection time control section 21, the injection time f is proportional to the values of width of the detection signals, and predetermined times f2>f3>f1 are automatically selected.

The injection nozzle device 4 is activated by the injection delay times and the injection times thus selected, and detected bad grains are removed by injection air from the injection nozzle device 4. In this case, the operation of the injection nozzle device 4 is set to the necessary injection time and the optimal delay time depending on whether the bad grain detected in the material G is a colored grain or a foreign matter such as glass or stone of a different falling-down speed, and depending on the magnitude of each detection signal. Therefore, it is possible to reduce the amount of air used by the injection nozzle device than the conventional art, that is, to reduce the running cost of the machine, and to sort only bad grains economically and accurately.

Incidentally, while the first embodiment captures the width of a detection signal as the magnitude of the detection signal, the magnitude is not limited to this, and it may be captured by other factors such as the area of a detection signal denoted by reference sign M in FIG. 3.

Also, in the second embodiment, the visible light sensors 12*a* and 12*b* detect the quantities of light from the material G which falls down from the transfer device 3 and reaches the optical detection position P. The values of detected quantities of light are converted into voltage values by the I/V converter. The voltage values are amplified by the amplifiers 14*a* and 14*b*, and output to the comparators 22*a* and 22*b* as detection signals. See FIG. 5.

Figure 8:
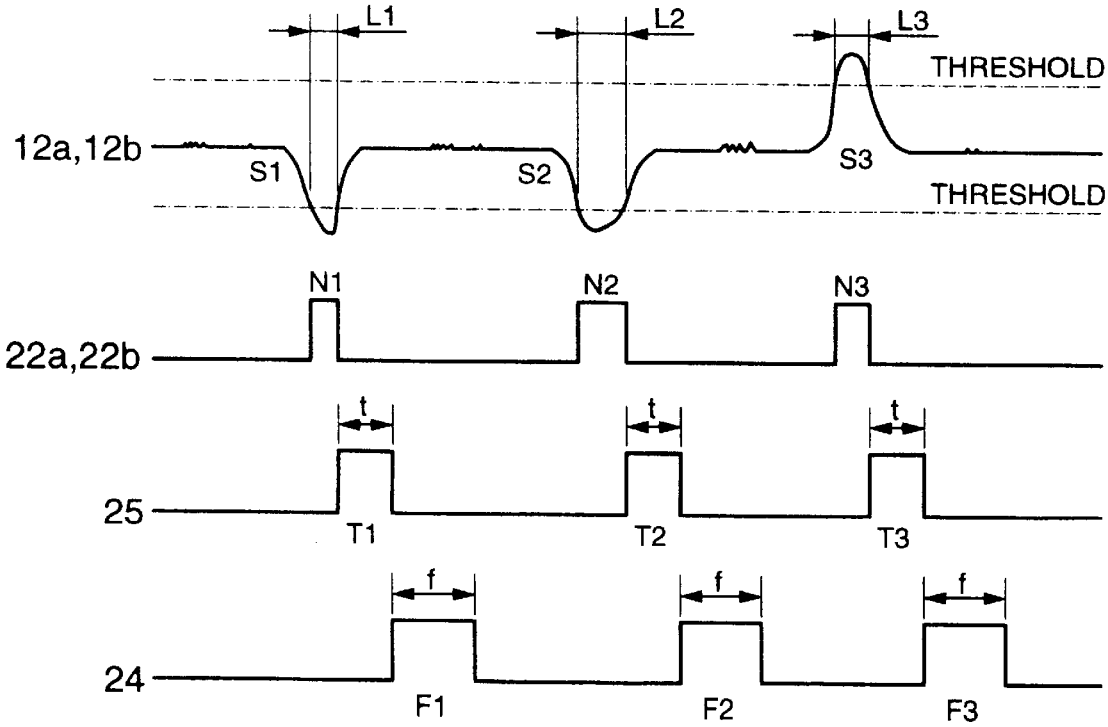
FIG. 8 is charts showing the output waveform of detection and control signals by a visible light sensor in the system of FIG. 5.
Figure 9:
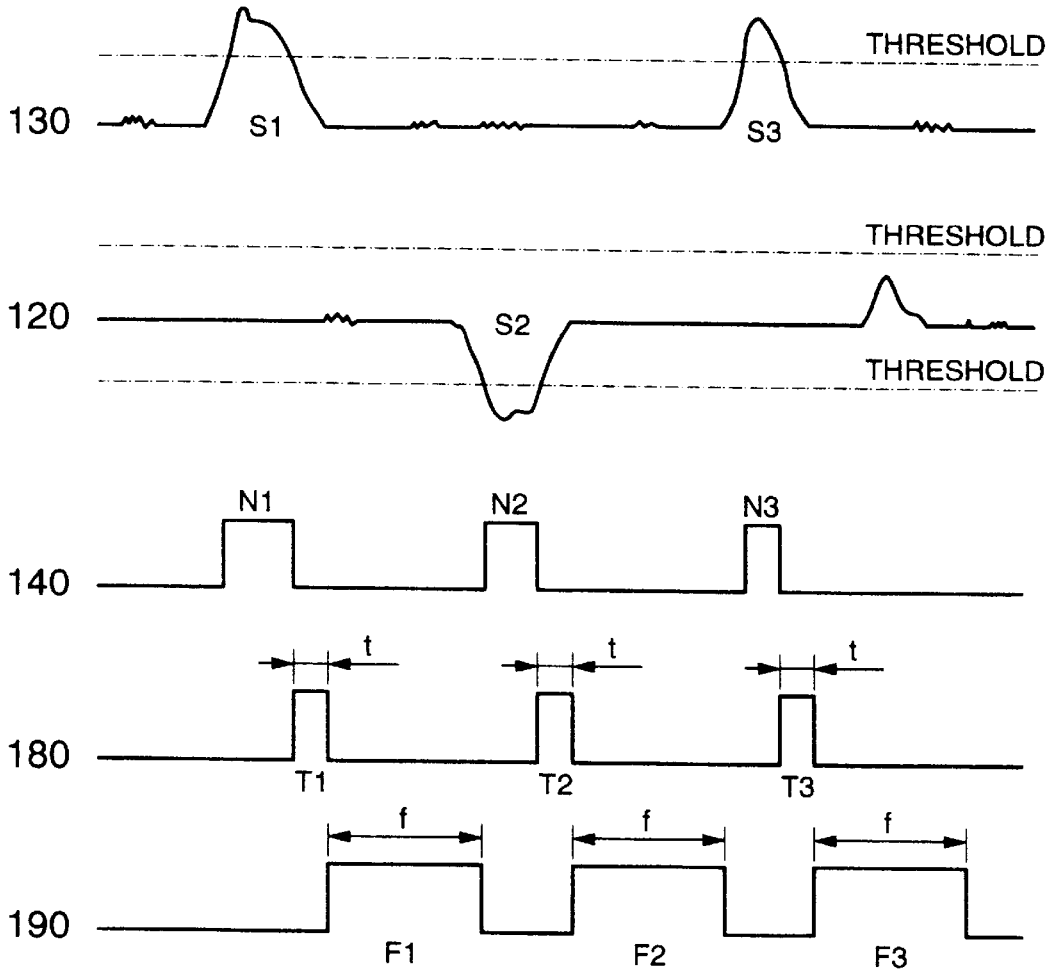
FIG. 9 PRIOR ART
FIG. 9 is charts showing the output waveforms of detection and control signals in a conventional granular material color sorting apparatus.

FIG. 8 shows the detection signals or voltage values S1, S2 and S3 corresponding to the quantities of detected light by the visible light sensors 12*a* and 12*b*. The comparator 22*a*, 22*b* compares the detection signals S1, S2 and S3 with the thresholds, if they exceed the thresholds, determines them as bad grains or colored grains, and outputs bad grain signals N1, N2 and N3 to the injection time control section 24. The injection time control section 24 selects a predetermined injection time f according to these bad grain signals, and sends it to the injection delay control section 25. Similarly, the injection delay control section 25 selects a predetermined injection delay time t, and outputs injection time signals F1, F2 and F3 together with injection delay time signals T1, T2 and T3 to a drive circuit (not shown) for activating the injection nozzle device 4. The injection time in this case is set relatively shorter by taking into account the fact that the colored grain detected has a specific gravity smaller than a foreign matter. On the other hand, the injection delay time is set relatively longer by taking into account the fact that a colored grain has a falling-down speed smaller than a foreign matter. Then, the injection nozzle device 4 receives these signals, and operates at the predetermined injection delay times and injection times.

Figure 7:
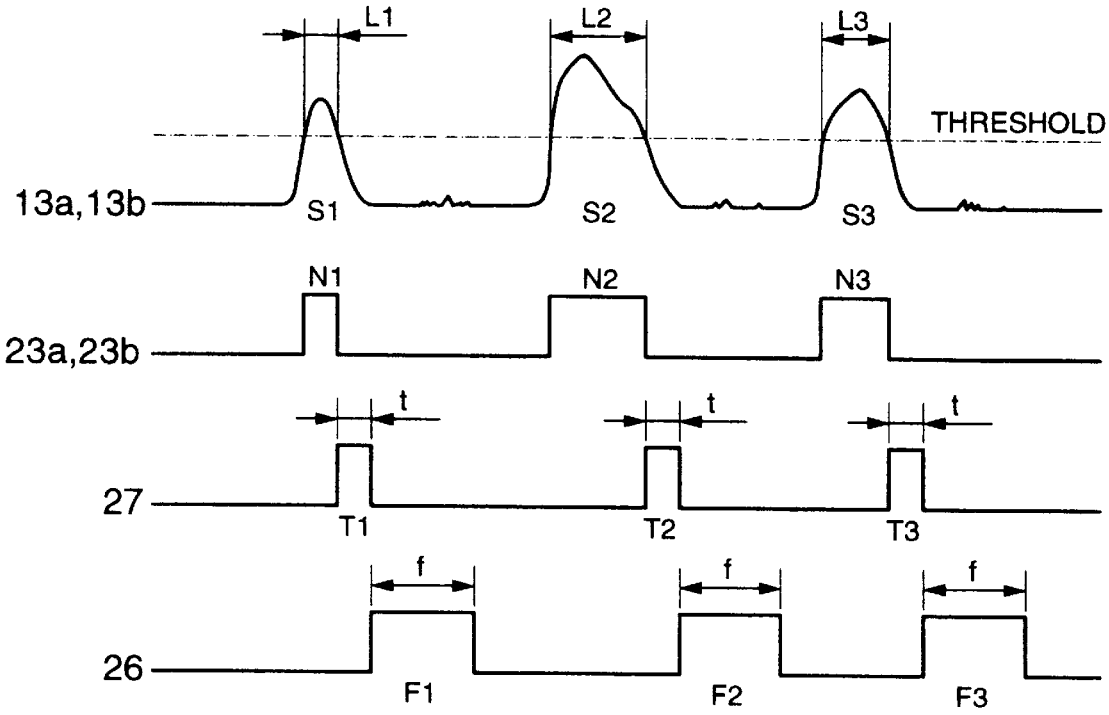
FIG. 7 is charts showing the output waveform of detection and control signals by a near infrared sensor in the system of FIG. 5.

FIG. 7 shows the detection signals or voltage values S1, S2 and S3 corresponding to the quantities of detected light by the visible light sensors 13*a* and 13*b*. The comparator 23*a*, 23*b* compares the detection signals S1, S2 and S3 with the threshold, if they exceed the threshold, determines them as bad grains or foreign matters, and outputs bad grain signals N1, N2 and N3 to the injection time control section 26. The injection time control section 26 selects a predetermined injection time f according to these bad grain signals, and sends it to the injection delay control section 27. Similarly, the injection delay control section 27 selects a predetermined injection delay time t, and outputs delay time signals F1, F2 and F3 together with injection delay time signals T1, T2 and T3 to a drive circuit (not shown) for activating the injection nozzle device 4. The injection time in this case is set relatively longer by taking into account the fact that the foreign matter detected has a specific gravity larger than a colored grain. On the other hand, the injection delay time is set relatively shorter by taking into account the fact that a foreign matter has a falling-down speed larger than a colored grain. Then, the injection nozzle device 4 receives these signals, and operates at the predetermined injection delay times and injection times.

As described, the second embodiment can also appropriately set the injection time f and the injection delay time t for colored grains and foreign matters, respectively, in sorting colored grains and foreign matters such as glass or stones mixed in the material cereal grains and having different falling-down speeds from each other. Therefore, it is possible to reduce the amount of air used by the injection nozzle device than in the conventional art, so that the running cost of the machine can be reduced to economically and accurately sort only bad grains.

In addition, when there is provided the input section 28 to which setting can be input, as described above, the injection times and the injection delay times for the injection time control section 24, 26 and the injection delay control section 25, 27 can be appropriately set in accordance with the situation of sorting through this input section by an operator.

On the other hand, in the third embodiment, each of the visible light sensors 12*a* and 12*b* is provided with the injection time control section 24*a* or 24*b* and the injection delay control section 25*a* or 25*b*. Therefore, the injection times and the injection delay times can be set in the injection time control sections 24*a* and 24*b*, and the injection delay control sections 25*a* and 25*b* in correspondence to the visible sensors 12*a* and 12*b*, respectively. In addition, also for the near infrared sensors 13*a* and 13*b*, the injection times and the injection delay times can be set in the injection time control sections 26*a* and 26*b*, and the injection delay control sections 27*a* and 27*b* in correspondence to the near infrared sensors 13*a* and 13*b*, respectively.

The injection times and the injection delay times are set in the injection time control sections 24*a*, 24*b*, 26*a* and 26*b*, and the injection delay control sections 25*a*, 25*b*, 27*a* and 27*b* in correspondence to the difference in specific gravity and falling-down speed between colored grains and foreign matter. That is, the injection time f for a case where a detected bad grain is a foreign matter such as glass or stone is set longer than that for a colored grain because the foreign matter has a higher specific gravity than the colored grain. In addition, the injection delay time for a foreign matter is set shorter than that for a colored grain because the foreign matter has a higher falling-down speed than the colored grain. Thus, the third embodiment attains similar operation and advantages to the second embodiment. In addition, while it is arranged that the visible light sensor 12*a* and the near infrared sensor 13*a*, as well as the visible light sensor 12*b* and the near infrared sensor 13*b* detect the quantities of light from the same position P, even if the optical detection position is shifted by, for example, displacement of the optical detection sections 9*a* and 9*b*, it is possible to prevent erroneous detection and removal of bad grains by changing and adjusting the injection time and the injection delay time for each sensor. This eliminates necessity of complicated adjusting operation such as correction of displacement of the optical detection position through fine adjustment for setting angles of the optical detection sections 9*a* and 9*b* or the like.

The input section 28 described for the second embodiment may be similarly used for the third embodiment.

While the first through third embodiments perform the optical detection of the material G at the same position P, the position for optically detecting colored grains may be different from the position for optically detecting foreign matters such as glass or stones. In this case, the injection time and the injection delay time are set for the injection time control section and the injection delay control section by taking into account the difference of the optical detection positions. That is, when the optical detection is done at different positions, there is a possibility that bad grains detected at the optical detection position remote from the injection nozzle device will not be removed because they have a long distance to reach the position of the injection nozzle device, and there will be variation in time to reach. However, since the present invention enables the actuation time of the injection nozzle device to be set for each optical sensor, there is no possibility in failing to blow off bad grains by adjusting the injection time to cover all variation of reaching time.

While the embodiments of the invention have been described, the invention is not limited to these specific forms, it should be understood that, within the scope of attached claims, various modifications may be made or the invention may take another form.

What is claimed is:

1. A granular material color sorting apparatus comprising a transfer device causing material grains to fall down in a substantially fixed locus; at least one optical detector unit mounted along the falling-down locus of the material grains, the optical detector unit including a colored grain detection sensor section for optically detecting colored grains different in color from good material grains and a foreign matter detection sensor section for optically detecting foreign matters in similar color to the good material grains or transparent; an injection nozzle device for injecting air to the material grains after optical detection to remove them; and a control unit for controlling operation of the injection nozzle device in response to the detection by the optical detector unit, the control unit having a comparator section for discriminating good material grains and bad grains of colored grains and foreign matters in response to output signals from the optical detector unit, an injection time control section for activating the injection nozzle device over a predetermined period of time in response to discrimination by the comparator section, and an injection delay control section for delaying activation of the injection nozzle device for a predetermined period of time after the detection by the optical detector unit, the injection time control section and the injection delay control section storing two sorts of injection times and injection delay times different in criterion for colored grains and for foreign matters, determining an injection time and an injection delay time depending on which of a colored grain and a foreign matter is detected and in accordance with the magnitude of a detection signal, and outputting the determined times to the inject nozzle device.

2. The sorting apparatus according to claim 1, wherein said injection time control section and said injection delay control section set the injection time and the injection delay time in the injection nozzle device depending on magnitude of a colored grain detection signal from the colored grain detection sensor section and on magnitude of a foreign matter detection signal from the foreign matter detection sensor section.

3. The sorting apparatus according to claim 2, wherein a pair of the injection time control section and the injection delay control section is provided for each of said colored grain detection sensor section and said foreign matter detection sensor section.

4. The sorting apparatus according to claim 1, wherein a pair of the injection time control section and the injection delay control section is provided for each of said colored grain detection sensor section and said foreign matter detection sensor section.

5. A granular material color sorting apparatus comprising a transfer device causing material grains to fall down in a substantially fixed locus; at least one optical detector unit mounted along the falling-down locus of the material grains, the optical detector unit including a colored grain detection sensor section for optically detecting colored grains different in color from good material grains and a foreign matter detection sensor section for optically detecting foreign matters in similar color to the good material grains or transparent; an injection nozzle device for injecting air to the material grains after optical detection to remove them; and a control unit for controlling operation of the injection nozzle device in response to the detection of the optical detector unit, said control unit having a comparator section for discriminating good material grains and bad grains of colored grains and foreign matters in response to output signals from the optical detector unit, an injection time control section for activating the injection nozzle device over a predetermined period of time in response to discrimination by the comparator section, and an injection delay control section for delaying activation of the injection nozzle device for a predetermined period of time after the detection by the optical detector unit, the injection time control section and the injection delay control section storing two sorts of injection times and injection delay times different in criterion for colored grains and for foreign matters, determining an injection time and an injection delay time depending on which of a colored gain and a foreign matter is detected and in accordance with magnitude of a detection signal, and outputting the determined times to the injection nozzle device and a set of the injection time control section and the injection delay control section being provided for each of said colored grain detection sensor section and said foreign matter detection sensor section.

6. The sorting apparatus according to claim 5, wherein said injection time control section and said injection delay control section are provided with an input section through which an injection time and an injection delay time are input and set.

* * * * *